US005329749A

United States Patent [19]

Yamamoto et al.

[11] Patent Number: 5,329,749

[45] Date of Patent: Jul. 19, 1994

[54] TABLET ENCAPSULATOR

[75] Inventors: Taizo Yamamoto, Osaka; Hirokazu Konishi, Sakurai, both of Japan

[73] Assignee: Japan Elanco Company Limited, Osaka, Japan

[21] Appl. No.: 121,910

[22] Filed: Sep. 16, 1993

Related U.S. Application Data

[63] Continuation of Ser. No. 978,403, Nov. 18, 1992, abandoned.

[30] Foreign Application Priority Data

Dec. 18, 1991 [JP] Japan ..... 3-361120

[51] Int. Cl.[5] ..... B65B 1/08; B65B 35/14; B65B 35/50

[52] U.S. Cl. ..... 53/525; 53/246; 53/532; 53/540; 53/900

[58] Field of Search ..... 53/900, 525, 247, 246, 53/539, 537, 532, 540, 158, 500

[56] References Cited

U.S. PATENT DOCUMENTS 3,347,016 10/1967 Silverman ..... 53/246
3,456,424 7/1969 Thurston et al. ..... 53/539 X
3,641,735 2/1972 Daily et al. ..... 53/537
4,685,271 8/1987 Ringer et al. ..... 53/246
4,693,057 9/1987 Rittinger et al. ..... 53/539
5,081,822 1/1992 Boyd et al. ..... 53/900 X
5,101,612 4/1992 Yamamoto et al. ..... 53/900 X

FOREIGN PATENT DOCUMENTS 2177074 1/1987 United Kingdom ..... 53/900 X

*Primary Examiner*—James F. Coan
*Attorney, Agent, or Firm*—Cushman, Darby & Cushman

[57] ABSTRACT

A tablet encapsulator deposits a predetermined number of tablets into each of a plurality of hard gelatin capsules. A tablet holding block has second guide holes for holding the predetermined number of tablets. A tablet carrier is reciprocated for a number of times equal to the predetermined number of tablets during a capsule filling sequence so that with each reciprocation, each of the second guide holes receives a single tablet until the predetermined number of tablets is received in each of the second guide holes. A shutter normally prevents the tablets from entering first guide holes in a first tablet guide shoot and intermittently permits the predetermined number of tablets to pass through each of the first guide holes and enter each of the capsules through their openings in synchronism with intermittent motion of a capsule holder.

19 Claims, 5 Drawing Sheets

TABLET ENCAPSULATOR

This is a continuation of application Ser. No. 07/978,403, filed on Nov. 18, 1992, which was abandoned upon the filing hereof.

BACKGROUND OF THE INVENTION

1. Field of the Invention

The present invention relates to an apparatus for encapsulating a predetermined number of tablets into a body of a hard gelatin capsule and, especially to such tablets having a slightly smaller external diameter than internal diameter of the body of the hard gelatin capsule.

2. Description of the Prior Art

Hard gelatin capsules are generally used as a package of powdery or granular medicine. In addition, the hard gelatin capsules are sometimes used for encapsulation of plural compact tablets therein. For example, in order to vary the quantity of medicine in conformity with symptoms or the age of a patient for example, the medicine is formed in small tablets, and the number of tablets to be prescribed to the patient is changed. Use of such small tablets is a nuisance both to the pharmacist preparing the medication and the patient taking the medication. Therefore, it is desirable for a predetermined number of the small tablets to be encapsulated in the hard gelatin capsule as a single encapsulated dose which can be prescribed to the patient.

A conventional tablet encapsulator apparatus for encapsulating tablets in a hard gelatin capsule is disclosed in published un-examined Japanese patent application sho 52-39494. In the known and conventional apparatus, the small tablets are encapsulated one by one in a respective gelatin capsule body.

Accordingly, in mass production, when a predetermined plural number of the small tablets are encapsulated, in the conventional fashion, in one hard gelatin capsule a plurality of tablets (the same number of the conventional tablet encapsulators as that of the above-mentioned predetermined number) must be lined up in each stroke.

In another way of encapsulating the predetermined number of the tablets in each stroke, it is necessary to stop the capsule holder until the predetermined number of the tablets are encapsulated in each hard gelatin capsule. As a result, the time period of the tablet encapsulating step becomes longer and the working ratio of the apparatus becomes lower and the moving speed of the apparatus becomes slower.

PURPOSE AND SUMMERY OF THE INVENTION

Purpose of the present invention is to solve the above mentioned problems of the conventional tablet encapsulator and to provide an improved tablet encapsulator which encapsulates the predetermined number of the tablets in a shorter capsule holder stroke than that of the prior art.

A tablet encapsulator in accordance with the present invention comprises: capsule holding means and for holding a plurality of hard gelatin capsules each having an opening for receiving a plurality of tablets; a first tablet guide shoot provided above the capsule holding means and having plural first guide holes for directing the tablets into the openings in the capsules; shutter means for manually preventing the tablets from entering the first guide holes and for intermittently permitting a predetermined number of tablets to pass through each of the first guide holes in the first tablet guide shoot and to enter each of the capsules through the openings in the capsules in synchronism with intermittent motion of the capsule holding means; a tablet holding block provided above the shutter means and having plural second guide holes each for holding the predetermined number of the tablets before the shutter means permits the predetermined number of tablets to pass through the first guide holes; a tablet carrier provided above the tablet holding block and having plural third guide holes with a depth less than or substantially the same as a thickness of the tablets, the tablet carrier being reciprocable to align the third guide holes with the second guide holes for a number of times equal to the predetermined number of tablets to be received by said capsules so that each of the second guide holes receives a single tablet until the predetermined number of tablets is received in each of the second guide holes; a second tablet guide shoot provided above the tablet carrier and having plural fourth guide holes for providing the tablets to the tablet carrier; and tablet supplying means provided above the second tablet guide shoot for supplying the tablets to the fourth guide holes.

In the tablet encapsulator configured above, the tablets contained in the tablet supplying means such as a hopper fall into each of the fourth guide holes of the second tablet guide shoot as a result of the vibration of the hopper. Actually, an internal space of each of the fourth guide holes is filled by the piled tablets. The lowest tablet in each of the fourth guide holes falls into the corresponding third guide hole of the tablet carrier and is carried by the reciprocative motion of the tablet carrier. When the third guide hole reaches just above the second guide hole, that is, when the second and the third guide holes are superposed, the tablet falls into the second guide hole. In an initial state, the bottom of the second guide hole is closed by the shutter means (shutter plate). The predetermined number of tablets are stored in each of the second guide holes by a corresponding number of reciprocative motions of the tablet carrier. When the predetermined number of the reciprocative motions of the tablet carrier is completed, the shutter plate is driven and the bottom of each of the second guide holes is opened. And thereby, the predetermined number of the tablets fall into each hard gelatin capsule body held on the capsule holding means (capsule holding pallet) through the first guide hole of the first tablet guide shoot.

According to the above-mentioned tablet encapsulator of the present invention, the predetermined number of tablets are preliminarily held in each guide hole of the tablet holding block for the predetermined number of reciprocal movements of the tablet carrying plate within one intermittent motion of the capsule holding means. The predetermined number of the tablets are encapsulated into the hard gelatin capsule body at a stretch by driving the shutter means when a new capsule holding means reaches and stops just below the first tablet guide shoot. Therefore, the predetermined number of the tablets can be encapsulated into the hard gelatin capsule body within each stroke of the intermittent motion of the capsule holding means. Furthermore, the time period in which the capsule holding means must stop just below the first tablet guide shoot can be shortened. As a result the working ratio of the total system can be improved.

While the novel features of the invention are set fourth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF A PREFERRED EMBODIMENT

Figure 1:
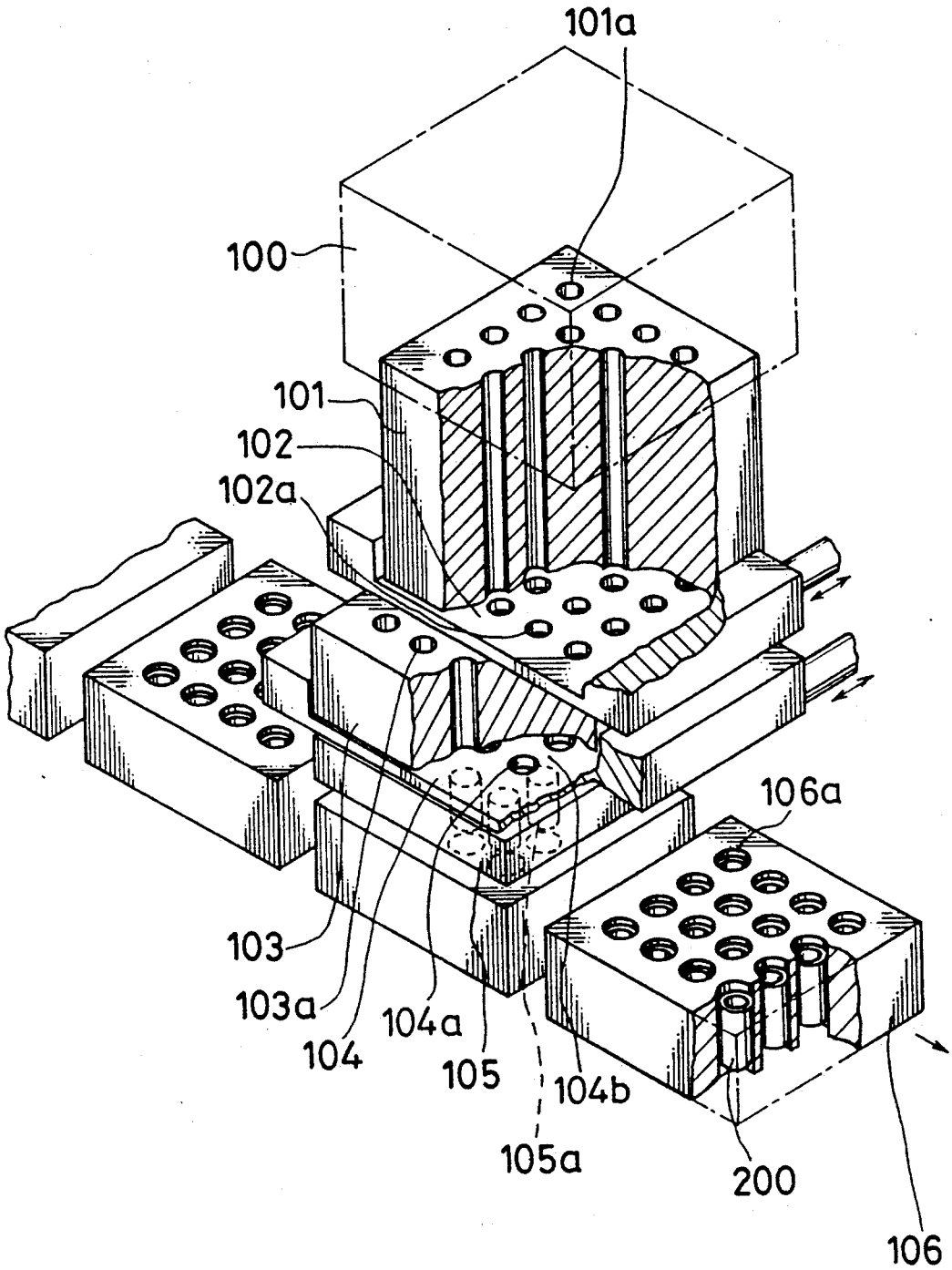
FIG. 1 is a perspective view showing a tablet encapsulator for encapsulation tablets in a hard gelatin capsule in accordance with the present invention.
Figure 2:
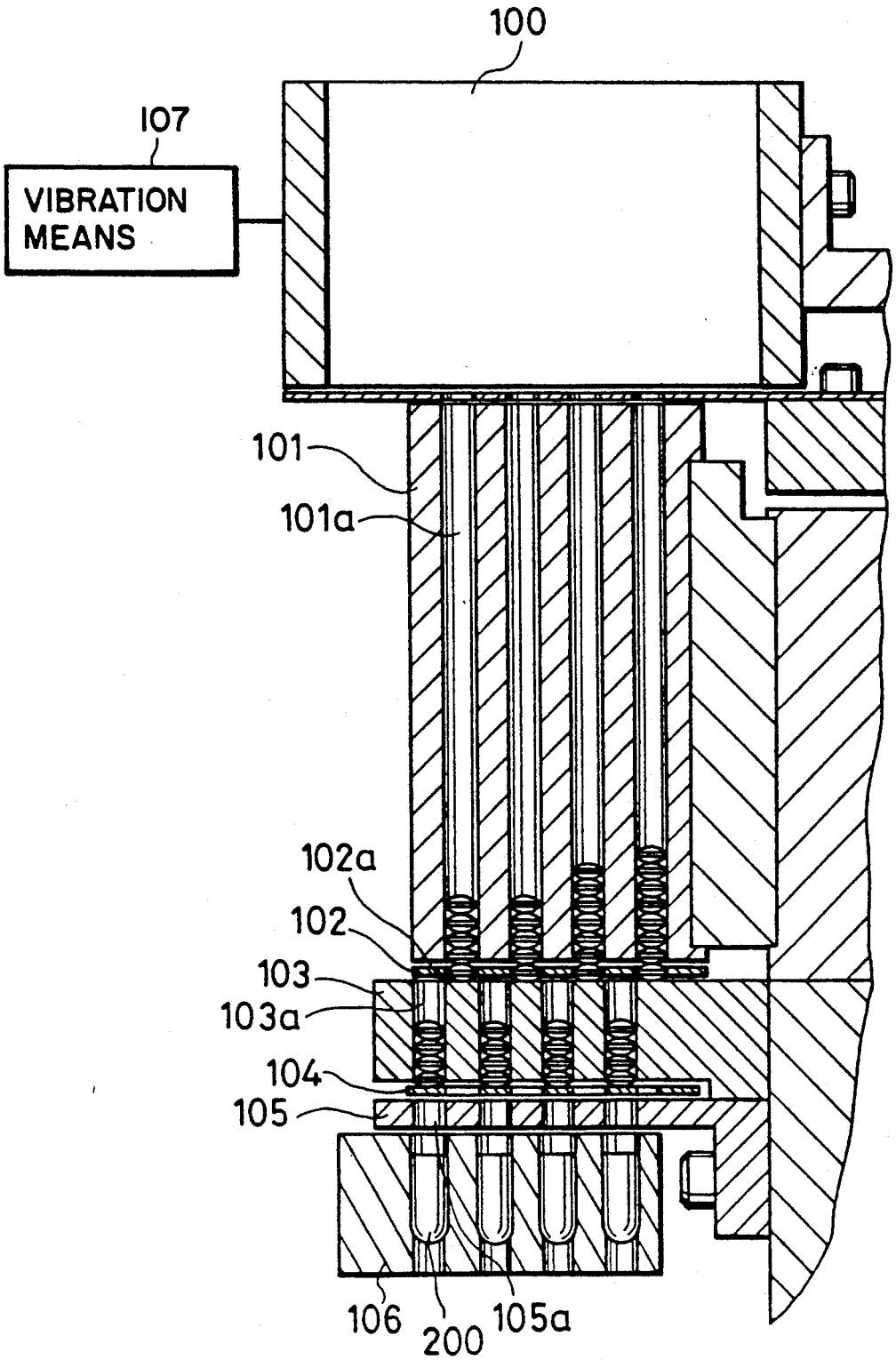
FIG. 2 is a sectional side view of the tablet encapsulator shown in FIG. 1.
Figure 3A:
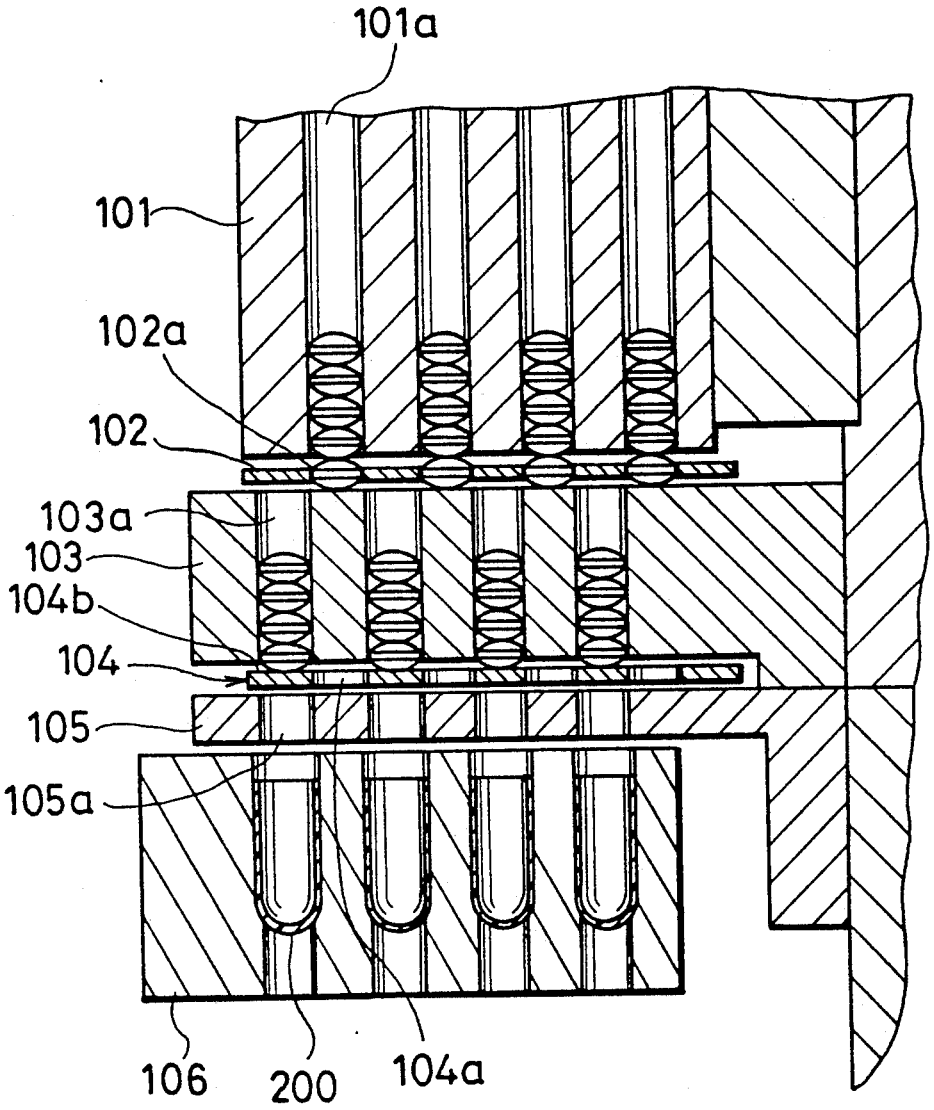
FIG. 3(A) is a sectional side view showing a sequential motion of the tablet encapsulator in accordance with the present invention.
Figure 3B:
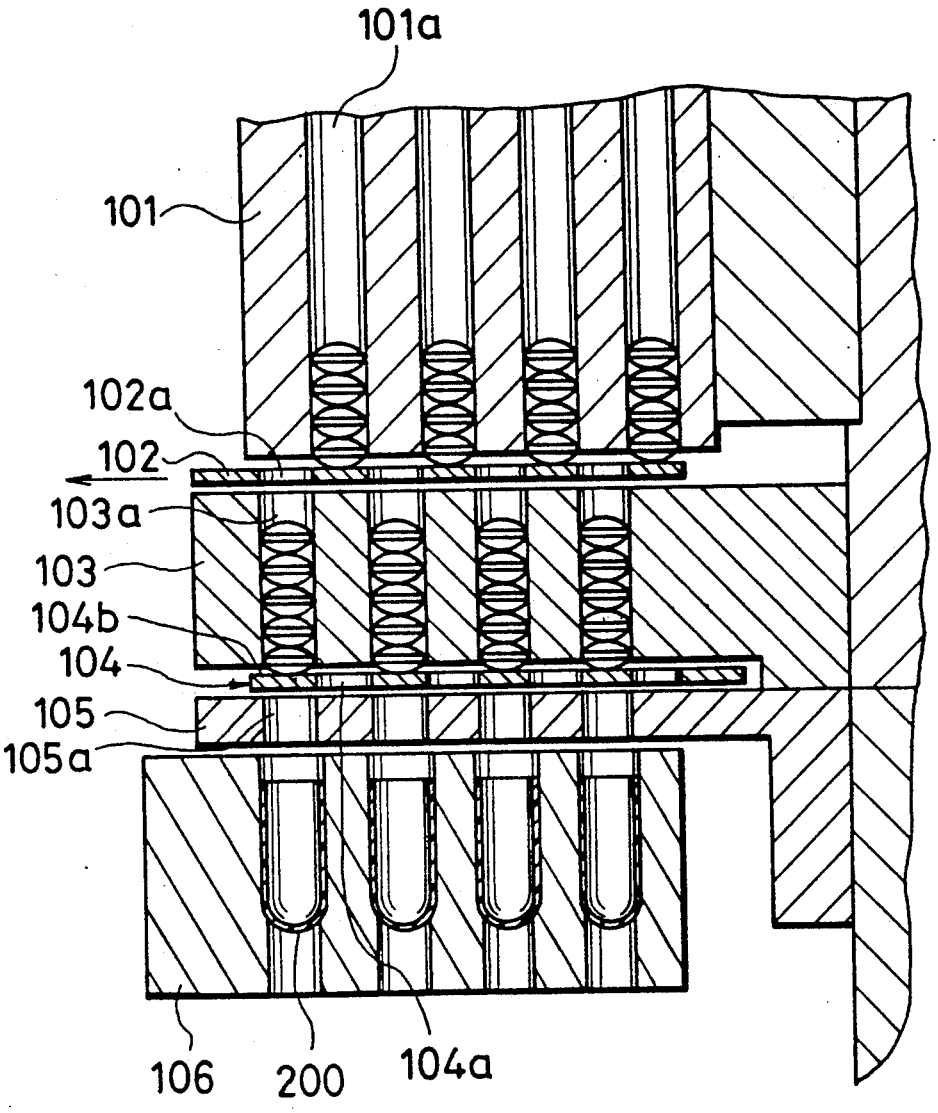
FIG. 3(B) is a sectional side view showing the sequential motion of the tablet encapsulator in accordance with the present invention.
Figure 3C:
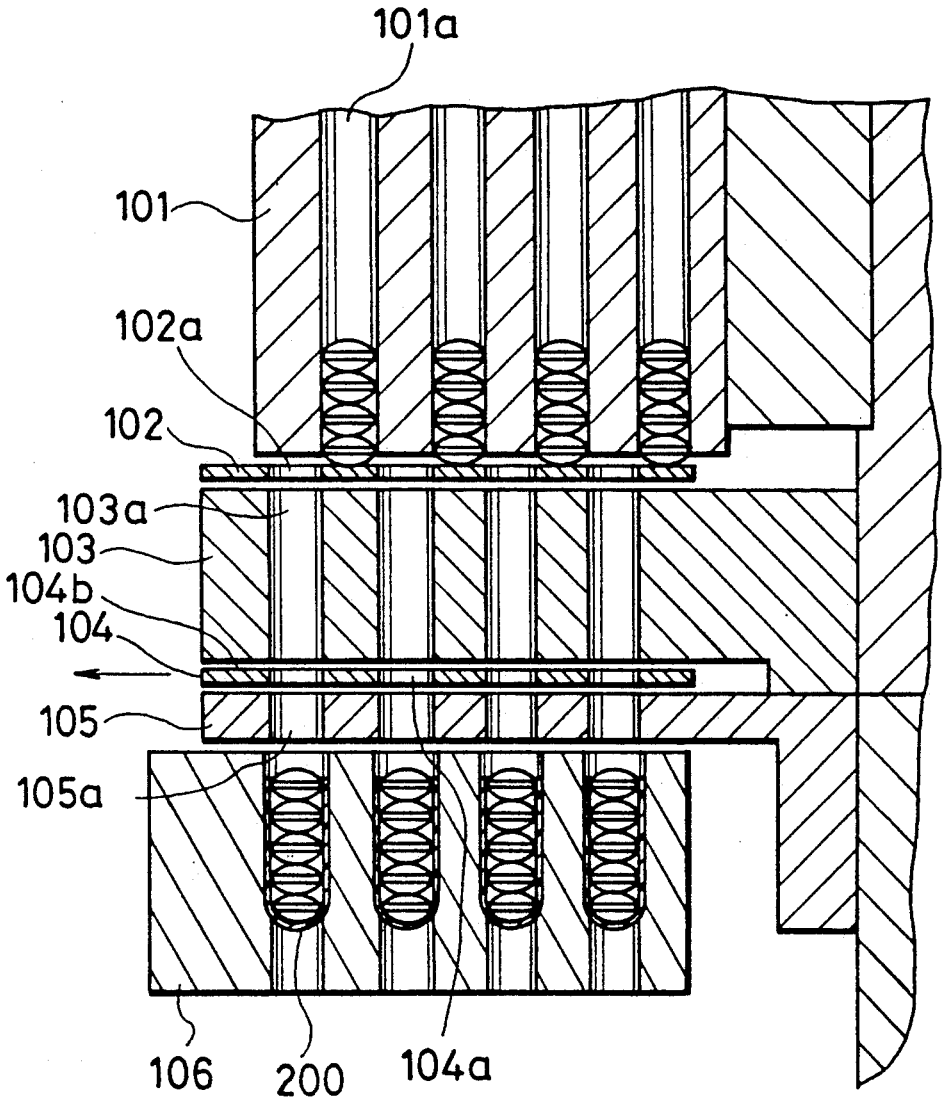
FIG. 3(C) is a sectional side view for showing the sequential motion of the tablet encapsulator in accordance with the present invention.

A preferred embodiment of a tablet encapsulator in hard gelatin capsule in accordance with the present invention is described referring to FIGS. 1, 2, 3(A), 3(B) and 3(C). FIG. 1 is a perspective view showing a configuration of the tablet encapsulator in accordance with the present invention. FIG. 2 is a sectional side view of the tablet encapsulator shown in FIG. 1. FIGS. 3(A) to 3(C) are sectional side views showing a sequential motion of the tablet encapsulator in accordance with the present invention.

In FIG. 1, a capsule holding pallet 106 has plural capsule holding holes 106*a* which are arranged in a matrix with a predetermined distance between each other. Plural bodies 200 of hard gelatin capsules are held by the capsule holding holes 106*a* in a manner that presents openings in bodies 200 upwards. The capsule holding pallet 106 is intermittently moved (linearly or rotationally) by a belt conveyor or the like.

A first tablet guide shoot 105 is provided above the capsule holding pallet 106 (or a moving path of the capsule holding pallet 106) with a predetermined clearance and it has plural first guide holes 105*a* which are arranged with the predetermined distance for facing the capsule holding holes 106*a* of the capsule holding pallet 106, respectively.

A shutter plate 104 is provided above the first tablet guide shoot 105 and is horizontally driven in synchronous reciprocation with, for example, the intermittent motion of the capsule holding pallet 106. The shutter plate 104 has plural openings 104*a* which are arranged respectively so as to face the capsule holding holes 106*a* of the capsule holding pallet 106 (and also the openings of the bodies 200 of the hard gelatin capsules) when the shutter plate 104 is moved in one direction. The shutter plate 104 also has covering portions for closing the capsule holding holes 106*a* when the shutter plate 104 is moved in the other direction.

A tablet holding block 103 is provided above the shutter plate 104 and has plural second guide holes 103*a* which are arranged respectively so as to face the first guide holes 105*a* of the first tablet guide shoot 105. thickness of the first tablet holding block 103 or the depth of the second guide holes 103*a* are selected to be larger than that which permits piling up of a predetermined number of the tablets therein. Thereby, the predetermined (plural) number of the tablets can be held safely in each of the second guide holes 103*a*.

Hereupon, the center axes of the capsule holding holes 106*a* of the capsule holding pallet 106, the corresponding first guide hole 105*a* of the first tablet guide shoot 105 and the corresponding second guide hole 103*a* of the tablet holding block 103 are aligned to coincide with each other.

A tablet carrying plate 102 is provided above the tablet holding block 103 and has plural third guide holes 102*a*. The third guide holes 102*a* are arranged respectively to face the second guide holes 103*a*. The depth of the third guide hole 102*a* (i.e., thickness of the tablet carrying plate 102) is selected to be smaller than the thickness of the tablet. This is for holding only one tablet in each of the third guide holes 102*a*. Of course the gap between the upper face of the tablet holding block 103 and the lower face of the second tablet guide shoot 101 is selected to be larger than the thickness of the tablet. The tablet carrying plate 102 is reciprocatingly driven the same time as the predetermined number of the tablets to be encapsulated in the horizontal direction for every one intermittent motion of the capsule holding pallet 106.

A second tablet guide shoot 101 is provided above the tablet carrying plate 102 and has plural fourth guide holes 101*a* which are arranged with the predetermined distance between each other in a manner to face the third guide holes 102*a* of the tablet carrying plate 102, respectively. However, the fourth guide hole 101*a* does not face the second guide holes 103*a* of the tablet holding block 103. Namely, the centers of the second guide hole 103*a* and the corresponding fourth guide hole 101*a* are not aligned with each other.

A tablet hopper 100, which is used for containing a plurality of the tablets, is provided above the second tablet guide shoot 101. The tablet hopper 100 is, for example, always vibrated by vibrating means 107, and thereby the tablets are supplied to each of the fourth guide holes 101*a* by the vibration.

A plurality of capsule holding pallets 106 are intermittently driven in sequence and in synchronism with other apparatuses for supplying and loading the hard gelatin capsules contained therein with tablets. The tablet carrying plate 102 and the shutter plate 104 are independently driven in reciprocation in the horizontal direction. However, the tablet carrying plate 102 is driven at predetermined times, and the shutter plate 104 is driven once for every motion of the capsule holding pallet 106 to a next step. Namely, the shutter plate 104 is set to be driven when one of the capsule holding pallet 106 reaches just below the first tablet guide shoot 105 and stops. On the other hand, the tablet carrying plate 102 is set to be driven at predetermined times for storing the predetermined number of the tablets to be encapsulated during the interval in which the capsule holding pallet 106 is moved to the next step and another capsule holding pallet comes just below the first tablet guide shoot 105 and stops there. The tablet carrying plate 102 and the shutter plate 104 are driven by independent actuators (such as motors, air cylinders or the like), individually. In an alternative species, the tablet carrying plate 102 and the shutter plate 104 are driven by a common actuator with a given speed changer (such as a cam, a gear train or the like) in a manner that the tablet carrying plate 102 is driven at the same times as that of the shutter plate 104.

Operation of the above mentioned embodiment of the tablet encapsulator in accordance with the present invention is described referring to FIGS. 3(A) to 3(C).

The tablets contained in the tablet hopper 100 fall into the fourth guide holes 101*a* of the second tablet guide shoot 101 by vibrating the hopper 100. Actually, each of the fourth guide holes 101*a* is filled by the piled tablets without any space.

As shown in FIG. 3(A), the lowest one of the piled tablets in each of the fourth guide holes 101*a* falls into the third guide hole 102*a* of the tablet carrying plate 102. And thereby, it is carried by the reciprocative motion of the tablet carrying plate 102. When each of the third guide holes 102*a* reaches just above the second guide hole 103*a*, namely when both guide holes 102*a* and 103*a* are aligned, the tablet falls into the second guide holes 102*a*.

At first, each bottom of the second guide hole 103*a* is shut by the shutter plate 104. As shown in FIG. 3(B), the predetermined number of the tablets are held in each of the second guide holes 103*a* of the tablet holding block 103 by reciprocal movement of the tablet carrying plate 102 at predetermined times. When the predetermined times of the reciprocal movement of the tablet carrying plate 102 is completed, the shutter plate 104 is driven and each of the bottom of the second guide hole 103*a* is opened. As shown in FIG. 3(C), the predetermined number of the tablets which are held in the second guide hole 103*a* fall into each of the body 200 of the hard gelatin capsule held on the capsule holding pallet 106 through the first guide hole of the first tablet guide shoot 105.

In the above-mentioned embodiment, the tablets are encapsulated into the body 200 of the hard gelatin capsule by utilizing natural drop caused by the gravity. However, when the tablets have a specific shape or a specific characteristics of the materials, the directions of the piled-up tablets may be diversified. Therefore, for piling the tablets in the same desirable posture shown in the figures (which is called a stable direction) for the tablets of the above-mentioned specific shape or nature, it is suitable to apply the vibration not only to the tablet hopper 100 but also to the second tablet guide shoot 101, the tablet holding block 103, the capsule holding pallet 106 and the like.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A tablet encapsulator comprising:

capsule holding means for holding a plurality of hard gelatin capsules each having an opening for receiving a plurality of tablets during a capsule filling sequence;

a first tablet guide shoot having plural first guide holes for directing said tablets into said openings in said capsules;

shutter means for normally preventing said tablets from entering the first guide holes and for intermittently permitting a predetermined number of tablets to pass through each of said first guide holes in said first tablet guide shoot and to enter each of said capsules through said openings in synchronism with intermittent motion of said capsule holding means;

a tablet holding block having plural second guide holes each for holding said predetermined number of the tablets before said shutter means permits said predetermined number of tablets to pass through each of said first guide holes;

a tablet carrier having plural third guide holes, said tablet carrier having a thickness being less than or substantially the same as a thickness of said tablets, said tablet carrier being reciprocable to align said third guide holes with said second guide holes for a number of times equal to the predetermined number of tablets to be received by said capsules during said capsule filling sequence so that with each reciprocation each of said second guide holes receives a single tablet until said predetermined number of tablets is received in each of said second guide holes;

a second tablet guide shoot having plural fourth guide holes for providing said tablets to said tablet carrier; and tablet supplying means for supplying said tablets to said fourth guide holes.

2. A tablet encapsulator in accordance with claim 1, further comprising vibration means for vibrating at least one of said tablet supplying means, said tablet holding block, said second tablet guide shoot and said capsule holding means.

3. A tablet encapsulator as claimed in claim 1, wherein said capsule holding means is a capsule holding pallet.

4. A tablet encapsulator as claimed in claim 3, wherein said shutter means is a shutter plate, said shutter plate being reciprocable to intermittently permit said predetermined number of tablets to pass through each of said first guide holes in said first tablet guide shoot.

5. A tablet encapsulator as claimed in claim 1, wherein said first guide holes in said first tablet guide shoot, said second guide holes in said tablet holding block, said third guide holes in said tablet carrier, and said fourth guide holes in said second tablet guide shoot are similarly arranged.

6. A tablet encapsulator as claimed in claim 1, wherein said first tablet guide shoot is disposed above said capsule holding means, said shutter means is disposed above said first tablet guide shoot, said tablet holding block is disposed above said shutter means, said tablet carrier is disposed above said tablet holding block, and said second tablet guide shoot is disposed above said tablet carrier.

7. A tablet encapsulator as claimed in claim 6, wherein the force of gravity moves said tablets through said tablet encapsulator.

8. A tablet encapsulator as claimed in claim 4, further comprising additional capsule holding pallets for holding a respective plurality of hard gelatin capsules and being sequentially cooperable with said first tablet guide shoot so that each of said respective capsules receives a predetermined number of tablets therefrom.

9. A tablet encapsulator as claimed in claim 8, wherein each of said capsule holding pallets remains cooperable with said first tablet guide shoot for a period of time which (i) allows said tablet carrier to reciprocate for said number of times equal to the predetermined number of tablets so that with each reciprocation each of said second guide holes receives a single tablet until said predetermined number of tablets is received in each of said second guide holes, and (ii) allows said shutter means to reciprocate once after said tablet carrier reciprocates for said number of times equal to permit said predetermined number of tablets received by said second guide holes to be removed from each of said second guide holes and pass through each of said first guide holes and into said capsules.

10. A tablet encapsulator comprising:

capsule holding means for holding a plurality of hard gelatin capsules each having an opening for receiving a plurality of tablets during a capsule filling sequence;

a first tablet guide shoot having plural first guide holes for directing said tablets into said openings in said capsules;

shutter means for normally preventing said tablets from entering the first guide holes and for intermittently permitting a predetermined number of tablets to pass through each of said first guide holes in said first tablet guide shoot and to enter each of said capsules through said openings in synchronism with intermittent motion of said capsule holding means;

a tablet holding block having plural second guide holes each for holding said predetermined number of tablets before said shutter means permits said predetermined number of tablets to pass through each of said first guide holes;

a tablet carrier having plural third guide holes, said tablet carrier having a thickness being less than or substantially the same as a thickness of said tablets, said tablet carrier being reciprocable to align said third guide holes with said second guide holes for a number of times equal to the predetermined number of tablets to be received by said capsules during said capsule filling sequence so that with each reciprocation each of said second guide holes receives a single tablet until said predetermined number of tablets is received in each of said second guide holes; and means for supplying said tablets to said tablet carrier.

11. A tablet encapsulator as claimed in claim 10, further comprising vibration means for vibrating at least one of said tablet supplying means, said tablet holding block, said second tablet guide shoot and said capsule holding means.

12. A tablet encapsulator as claimed in claim 10, wherein said capsule holding means is a capsule holding pallet.

13. A tablet encapsulator as claimed in claim 12, wherein said shutter means is a shutter plate, said shutter plate being reciprocable to intermittently permit said predetermined number of tablets to pass through each of said first guide holes in said first tablet guide shoot.

14. A tablet encapsulator as claimed in claim 10, wherein said first guide holes in said first tablet guide shoot, said second guide holes in said tablet holding block, said third guide holes in said tablet carrier, and said fourth guide holes in said second tablet guide shoot are similarly arranged.

15. A tablet encapsulator as claimed in claim 10, wherein said first tablet guide shoot is disposed above said capsule holding means, said shutter means is disposed above said first tablet guide shoot, said tablet holding block is disposed above said shutter means, said tablet carrier is disposed above said tablet holding block, and said second tablet guide shoot is disposed above said tablet carrier.

16. A tablet encapsulator as claimed in claim 15, wherein the force of gravity moves said tablets through said tablet encapsulator.

17. A tablet encapsulator as claimed in claim 13, further comprising additional capsule holding pallets for holding a respective plurality of hard gelatin capsules and being sequentially cooperable with said first tablet guide shoot so that each of said respective capsules receives a predetermined number of tablets therefrom.

18. A tablet encapsulator as claimed in claim 17, wherein each of said capsule holding pallets remains cooperable with said first tablet guide shoot for a period of time which (i) allows said tablet carrier to reciprocate for said number of times equal to the predetermined number of tablets so that with each reciprocation each of said second guide holes receives a single tablet until said predetermined number of tablets is received in each of said second guide holes, and (ii) allows said shutter means to reciprocate once after said tablet carrier reciprocates for said number of times to permit said predetermined number of tablets received by said second guide holes to be removed from each of said second guide holes and pass through each of said first guide holes and into said capsules.

19. A tablet encapsulator comprising:

capsule holding means intermittently driven and holding plural bodies of hard gelatin capsules with their openings upward with a predetermined distance between each other;

a first tablet guide shoot provided above said capsule holding means and having plural first guide holes which are facing said openings of said bodies of said hard gelatin capsules with a predetermined clearance, respectively;

shutter means provided above said first tablet guide shoot and driven for opening said first guide holes in synchronism with said intermittent motion of said capsule holding means;

a tablet holding block provided above the shutter means and having plural second guide holes for holding a predetermined number of the tablets, said second guide holes respectively facing said first guide holes and having a depth deeper than that which permits piling up of said predetermined number of said tablets;

a tablet carrier provided above said tablet holding block, having plural third guide holes which are provided with said predetermined distance between each other for facing said second guide holes, respectively and have a depth shorter than or substantially the same as the thickness of said tablet, and said tablet carrier reciprocated the same number of times as the predetermined number of tablets to be loaded into said capsule;

a second tablet guide shoot provided above said tablet carrier and having plural fourth guide holes which are provided with said predetermined distance between each other for facing said third guide holes of said tablet carrier but not facing said second guide holes of said tablet holding block; and tablet supplying means provided above said second tablet guide shoot for supplying said tablets to said fourth guide holes in sequence.

* * * * *